US010941985B2

(12) United States Patent
Ito et al.

(10) Patent No.: US 10,941,985 B2
(45) Date of Patent: Mar. 9, 2021

(54) HEAT EXCHANGER

(71) Applicant: Mitsubishi Electric Corporation, Tokyo (JP)

(72) Inventors: Daisuke Ito, Tokyo (JP); Shin Nakamura, Tokyo (JP); Yuki Ugajin, Tokyo (JP); Tsuyoshi Maeda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/075,691

(22) PCT Filed: Apr. 22, 2016

(86) PCT No.: PCT/JP2016/062754
§ 371 (c)(1),
(2) Date: Aug. 6, 2018

(87) PCT Pub. No.: WO2017/183180
PCT Pub. Date: Oct. 26, 2017

(65) Prior Publication Data

US 2019/0049185 A1 Feb. 14, 2019

(51) Int. Cl.

| | |
|---|---|
| ***F28D 1/02*** | (2006.01) |
| ***F28D 1/053*** | (2006.01) |
| ***F28F 17/00*** | (2006.01) |
| ***F28F 1/02*** | (2006.01) |

(52) U.S. Cl.
CPC ..... *F28D 1/024* (2013.01); *F28D 1/0246* (2013.01); *F28D 1/05308* (2013.01);
(Continued)

(58) Field of Classification Search
CPC .... F28D 1/024; F28D 1/0246; F28D 1/05391; F28D 1/05308; F28F 1/02; F28F 17/005; F28F 1/325
(Continued)

(56) References Cited

U.S. PATENT DOCUMENTS 3,266,567 A * 8/1966 Lubomyr ..... F28F 1/325 165/151
5,501,270 A * 3/1996 Young ..... F28F 1/325 165/151
(Continued)

FOREIGN PATENT DOCUMENTS

JP S48-58434 A 8/1973
JP S63-003183 A 1/1988
(Continued)

OTHER PUBLICATIONS

International Search Report of the International Searching Authority dated Jul. 26, 2016 for the corresponding international application No. PCT/JP2016/062754 (and English translation).
(Continued)

*Primary Examiner* — Tho V Duong
(74) *Attorney, Agent, or Firm* — Posz Law Group, PLC

(57) ABSTRACT

A heat exchanger includes a plurality of flat tubes provided to extend in a first direction, and a plurality of plate-shaped fins having respective surfaces extending in a second direction. The surface has a windward edge and a leeward edge. The plurality of flat tubes include a first flat tube disposed most windward in the second direction, and a second flat tube spaced apart from the first flat tube and disposed most leeward in the second direction. In the second direction, a distance between the leeward edge and a center of a flat shape of the second flat tube is at least one-third of a width between the windward edge and the leeward edge.

17 Claims, 8 Drawing Sheets

(52) U.S. Cl.
CPC ..... *F28D 1/05391* (2013.01); *F28F 1/02* (2013.01); *F28F 17/005* (2013.01)

(58) Field of Classification Search
USPC ..... 165/151
See application file for complete search history.

(56) References Cited

U.S. PATENT DOCUMENTS

| | | | | |
|---|---|---|---|---|
| 2011/0094258 | A1* | 4/2011 | Lee | F28D 1/0478 62/498 |
| 2015/0068244 | A1 | 3/2015 | Lee et al. | |

FOREIGN PATENT DOCUMENTS

| | | | | | |
|---|---|---|---|---|---|
| JP | 02154987 | A | * | 6/1990 | F28F 1/325 |
| JP | 2001-165586 | A | | 6/2001 | |
| JP | 2001165586 | A | * | 6/2001 | F28D 1/05366 |
| JP | 2003-262485 | A | | 9/2003 | |
| JP | 4186359 | B2 | | 11/2006 | |
| JP | 2013-245884 | A | | 12/2013 | |
| JP | 2014-020704 | A | | 2/2014 | |
| WO | 2013/161802 | A1 | | 10/2013 | |

OTHER PUBLICATIONS

Office Action dated Sep. 10, 2019 issued in corresponding JP patent application No. 2018-512740 (and English translation).
Office Action dated Mar. 31, 2020 issued in corresponding JP patent application No. 2018-512740 (and English translation).
Office Action dated Aug. 25, 2020 issued in corresponding GB patent application No. 1813323.1.

* cited by examiner

HEAT EXCHANGER

CROSS REFERENCE TO RELATED APPLICATION

This application is a U.S. national stage application of PCT/JP2016/062754 filed on Apr. 22, 2016, the contents of which are incorporated herein by reference.

TECHNICAL FIELD

The present invention relates to a heat exchanger, and particularly, to a heat exchanger used as an evaporator in, for example, an air conditioner or a refrigerator.

BACKGROUND ART

A heat-and-tube heat exchanger known in the art includes a plurality of plate-shaped fins layered at predetermined fin pitch intervals and a plurality of flat heat transfer tubes (flat tubes) having a cross-section of a flat shape, such as an approximately oval shape or an approximately elliptic shape. In such a heat exchanger, cut-away portions (e.g., through-holes) are formed at positions that overlap one another in the direction in which the plurality of plate-shaped fins are layered. Each cut-away portion has a flat shape as seen in plan view, into which one flat tube can be inserted. The end of each flat tube is connected to a distribution tube or a header. Such a fin-and-tube heat exchanger is provided to perform heat exchange between a heat exchange fluid flowing between the plurality of plate-shaped fins, such as air, and a target heat exchange fluid, such as water or refrigerant flowing in the plurality of flat tubes. This type of heat exchanger is generally provided such that the direction in which the plurality of plate-shaped fins are layered, that is, the direction in which the flat tubes extend, extends horizontally.

When operated as an evaporator, the heat exchanger generates the moisture in the air (heat exchange fluid) as condensed water on the heat exchanger. A fin-and-tube heat exchanger is known in which the long axis of the flat tube is provided to be inclined to the horizontal direction in order to drain such condensed water out of the heat exchanger (see Japanese Patent Laying-Open No. 2013-245884).

CITATION LIST

Patent Document

PTD 1: Japanese Patent Laying-Open No. 2013-245884

SUMMARY OF INVENTION

Technical Problem

A conventional fin-and-tube heat exchanger, however, has an insufficient drainage efficiency. For example, when the long axis of the flat tube is relatively long, condensed water may stay on the flat tube without being immediately drained through the flat tube. The present invention has been made to solve the above problem. The present invention provides a heat exchanger with high drainage efficiency.

Solution to Problem

A heat exchanger according to an embodiment of the present invention includes a plurality of flat tubes provided to extend in a first direction, and a plurality of plate-shaped fins having respective surface extending in a second direction different from the first direction. The surfaces of the plurality of plate-shaped fins are spaced apart from each other in the first direction. Each of the surfaces has a windward edge located windward in the second direction and a leeward edge located leeward in the second direction. The plurality of flat tubes penetrate the surfaces. The plurality of flat tubes include a first flat tube disposed most windward in the second direction, and a second flat tube spaced apart from the first flat tube and disposed most leeward in the second direction. In the second direction, a distance between the leeward edge of each of the surfaces and a center of a flat shape of the second flat tube is at least one-third of a width between the windward edge and the leeward edge of each of the surfaces.

A heat exchanger according to another embodiment of the present invention includes a plurality of flat tubes provided to extend in a first direction, and a plurality of plate-shaped fins having respective surfaces extending in a second direction different from the first direction. The surfaces of the plurality of plate-shaped fins are spaced apart front each other in the first direction. Each of the surfaces has a windward edge located windward in the second direction and a leeward edge located leeward in the second direction. The plurality of flat tubes penetrate the surfaces. The plurality of flat tubes include a first flat tube disposed most windward in the second direction, and a second flat tube spaced apart from the first flat tube and disposed most leeward in the second direction. In the second direction, a distance between the windward edge of each of the surfaces and a center of a flat shape of the first flat tube is at least one-third of a width between the windward edge and the leeward edge of each of the surfaces.

Advantageous Effects of Invention

The present invention can provide a heat exchanger with high drainage efficiency.

DESCRIPTION OF EMBODIMENTS

Figure 1:
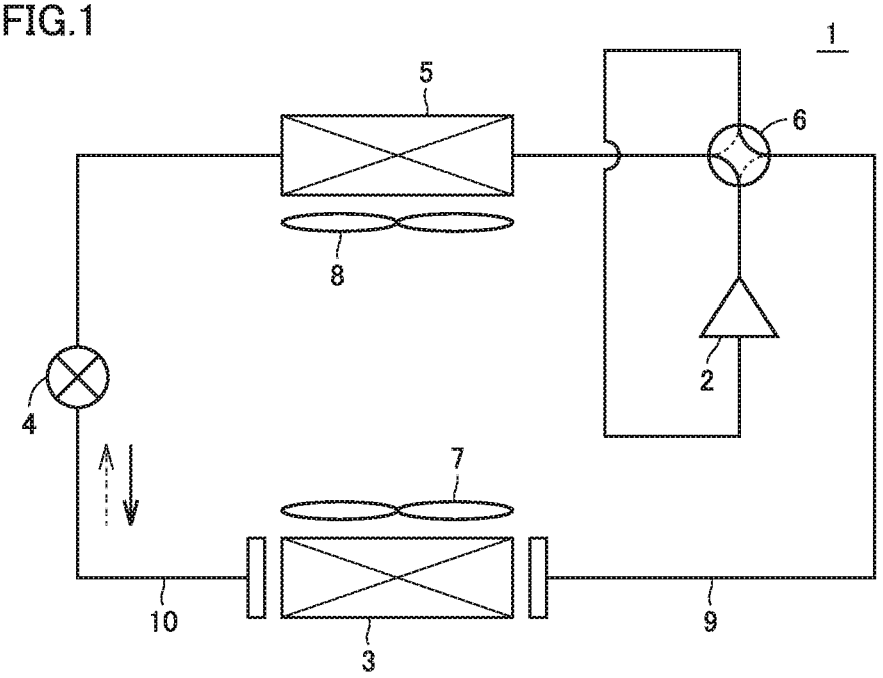
FIG. 1 shows an air conditioner according to Embodiment 1.

Embodiments of the present invention will be described below with reference to the drawings, in which the same or corresponding parts will be designated by the same reference numerals, and a description thereof will not be repeated.

Embodiment 1

<Configuration of Air Conditioner>

An air conditioner 1 according to Embodiment 1 will be described with reference to FIG. 1. Air conditioner 1 includes a compressor 2, an outdoor heat exchanger 3, an expansion valve 4, an indoor heat exchanger 5, a four-way valve 6, an outdoor fan 7, and an indoor fan 8. For example, compressor 2, outdoor heat exchanger 3, expansion valve 4, and four-way valve 6 are provided in an outdoor unit, and indoor heat exchanger 5 is provided in an indoor unit.

Compressor 2, outdoor heat exchanger 3, expansion valve 4, indoor heat exchanger 5, and four-way valve 6 are connected to each other through a refrigerant tube and constitute a refrigerant circuit in which refrigerant can circulate. Air conditioner 1 performs a refrigerating cycle in which the refrigerant circulates in the refrigerant circuit while changing its phase.

Compressor 2 compresses refrigerant. Outdoor heat exchanger 3 is a fin-and-tube heat exchanger and includes a plurality of flat tubes and a plurality of plate-shaped fins (described below in detail). Outdoor heat exchanger 3 performs heat exchange between the refrigerant flowing in the flat tubes and the outside air flowing between the plate-shaped fins. Expansion valve 4 expands refrigerant. Indoor heat exchanger 5 performs heat exchange between refrigerant and indoor air. Four-way valve 6 can switch a flow path for flammable refrigerant in air conditioner 1. Outdoor fan 7 blows outside air to outdoor heat exchanger 3. Indoor fan 8 blows indoor air to indoor heat exchanger 5.

<Outdoor Heat Exchanger>

Outdoor heat exchanger 3 according to Embodiment 1 will now be described with reference to FIGS. 2 and 3. In outdoor heat exchanger 3, the refrigerant as a target heat exchange fluid flows in a first direction A. The air as a heat exchange medium flows in a second direction B different from first direction A. First direction A and second direction B are, for example, the directions crossing the direction of gravity (vertical direction), which are, for example, the directions extending horizontally. Second direction B is, for example, the direction orthogonal to first direction A.

Outdoor heat exchanger 3 includes a plurality of flat tubes 11 and a plurality of plate-shaped fins (plate fins) 12. Flat tubes 11 are provided to extend in first direction A. Flat tubes 11 are spaced apart from each other in second direction B different from first direction A. Further, flat tubes 11 are separated apart from each other in, for example, a third direction C crossing first direction A and second direction B. Third direction C is a direction crossing the horizontal direction, which is, for example, the direction extending in the direction of gravity. Third direction C is, for example, a direction orthogonal to first direction A and second direction B. Flat tubes 11 each have a flat shape in which a cross-section perpendicular to first direction A has a long axis and a short axis. The cross-section of each of flat tubes 11 has, for example, an approximately oval shape or an approximately elliptic shape. A plurality of through-holes 11H extending in first direction A are provided inside each flat tube 11. The refrigerant can flow in through-holes 11H of flat tubes 11.

Plate-shaped fins 12 are spaced apart from each other in first direction A. Plate-shaped fins 12 each have a surface 12S provided to extend in second direction B. Each surface 12S is provided with as many through-holes as flat tubes 11. The through-holes provided in surfaces 12S are provided at different positions that overlap one another when plate-shaped fins 12 are seen in first direction A. One flat tube 11 is inserted into each of the through-holes provided in plate-shaped fins 12. Each plate-shaped fin 12 is fixed to flat tube 11 inserted into the through-hole by, for example, brazing, mechanical tube expansion, gas pressure tube expansion, or fluid pressure tube expansion. Surfaces 12S of plate-shaped fins 12 each have a windward edge 12A located windward in the second direction and a leeward edge 12B located leeward in the second direction. A width L of surface 12S of plate-shaped fin 12 between windward edge 12A and leeward edge 12B is, for example, 40 mm or less.

Flat tubes 11 include a first flat tube 13 and a second flat tube 14. First flat tube 13 is disposed most windward among flat tubes 11. Second flat tube 14 is disposed most leeward among flat tubes 11. That is to say, first flat tube 13 and second flat tube 14 are spaced apart from each other at an interval W in second direction B. Interval W between first flat tube 13 and second flat tube 14 is preferably 2 mm or more.

First flat tube 13 and second flat tube 14 spaced apart from each other at interval W in the second direction constitute a flat tube group. Flat tubes 11 include a plurality of such flat tube groups. Flat tube groups are spaced apart from each other in third direction C. First flat tubes 13 of the respective flat tube groups are spaced apart from each other in third direction C. Second flat tubes 14 of the respective flat tube groups are spaced apart from each other in third direction C.

First flat tube 13 and second flat tube 14 each may have any appropriate configuration and have, for example, a similar configuration. A length X of the long axis of the sectional shape of first flat tube 13 which is perpendicular to first direction A (the long axis of the flat shape) is equal to, for example, a length Y of the long axis of the sectional shape of second flat tube 14 which is perpendicular to first direction A (the long axis of the flat shape). The length of the short axis of the flat shape of first flat tube 13 is equal to, for example, the length of the short axis of the flat shape of second flat tube 14.

A ratio (X+Y)/L of a sum of the lengths of the long axes of first flat tube 13 and second flat tube 14 to width L of plate-shaped fin 12 is preferably 0.27 or more and 0.9 or less. Since the lengths of the long axes of first flat tube 13 and second flat tube 14 increase as ratio (X+Y)/L decreases, the sectional areas of the flow paths thereof become smaller accordingly. At a ratio (X+Y)/L of 0.27 or more, a decrease in the sectional areas of the flow paths can be compensated by increasing the number of flat tubes other than first flat tube 13 and second flat tube 14 to prevent a decrease in the sum total of the sectional areas of the flow paths of flat tubes 11. However, the number of flat tubes in the heat exchanger is limited by, for example, the size of the heat exchanger. At a ratio (X+Y)/L of less than 0.27, such a limitation on the number of flat tubes makes it difficult to compensate for a large decrease in the sectional areas of the flow paths only by an increase in the number of flat tubes. In this case, for example, the heat exchange performance of the heat exchanger needs to be decreased by decreasing the flow rate of the refrigerant in order to suppress an increase in the pressure loss of the refrigerant associated with the decrease in the sectional areas of the flow paths. In contrast, the lengths of the long axes of first flat tube 13 and second flat tube 14 increase as ratio (X+Y)/L increases. Width L of plate-shaped fin 12 is generally 40 mm or less. At a ratio (X+Y)/L exceeding 0.9, it is thus difficult to set interval W between first flat tube 13 and second flat tube 14 and a distance between a first end 13A of first flat tube 13 and windward edge 12A of plate-shaped fin 12 to 2 mm or more. Outdoor heat exchanger 3 can increase drainage efficiency while suppressing a decrease in the pressure loss of the refrigerant, at a ratio (X+Y)/L of 0.27 or more and 0.9 or less.

First flat tube 13 has first end 13A located windward and a second end 13B located leeward. Second flat tube 14 has a third end 14A located windward and a fourth end 14B located leeward. First end 13A and second end 13B of first flat tube 13 and third end 14A and fourth end 14B of second flat tube 14 are disposed in second direction B. In other words, the long axis of the flat shape of first flat tube 13 and the long axis of the flat shape of second flat tube 14 are arranged in second direction B. First end 13A of first flat tube 13 is disposed leeward of windward edge 12A of plate-shaped fin 12. Fourth end 14B of second flat tube 14 is disposed windward of leeward edge 12B of plate-shaped fin 12.

In second direction B, a distance u between the center of the flat shape of second flat tube 14 (a line segment 14C extending in the third direction through the center) and leeward edge 12B of plate-shaped fin 12 is at least one-third of width L of plate-shaped fin 12.

In second direction B, a distance s between the center of the flat shape of first flat tube 13 (a line segment 13C extending in the third direction through the center) and windward edge 12A of plate-shaped fin 12 is less than one-third of width L of plate-shaped fin 12. Distance u is greater than distance s.

Figure 2:
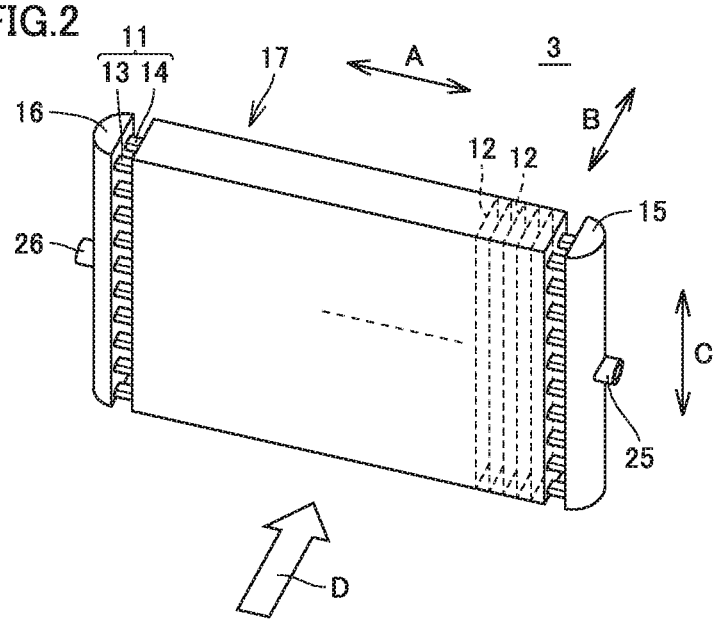
FIG. 2 is a perspective view of a heat exchanger according to Embodiment 1.

It suffices that outdoor heat exchanger 3 has any configuration as long as it has the above configuration, and as shown in FIG. 2, for example, it further includes a first header 15 and a second header 16.

Flat tubes 11 are connected to first header 15 at one end in first direction A. Flat tubes 11 are connoted to second header 16 at the other end in first direction A. First header 15 is provided so as to distribute the refrigerant to flat tubes 11. Second header 16 is provided so as to distribute the refrigerant to flat tubes 11. First header 15 is provided with a refrigerant port 25. Refrigerant port 25 of first header 15 is connected to expansion valve 4 through, for example, a refrigerant pipe 10. Second header 16 is provided with a refrigerant port 26. Refrigerant port 26 of second header 16 is connected to four-way valve 6 through, for example, a refrigerant pipe 9. Refrigerant port 25 may be connected to four-way valve 6 through refrigerant pipe 9, and refrigerant port 26 may be connected to expansion valve 4 through refrigerant pipe 10.

The material for outdoor heat exchanger 3 (flat tubes 11 and plate-shaped fins 12) is, for example, aluminum (Al) or Al alloy. The material for refrigerant pipes 9 and 10 is, for example, copper (Cu) or Cu alloy. Outdoor heat exchanger 3 is manufactured, for example, as described below. When flat tubes 11 and plate-shaped fins 12 are fixed by brazing, flat tubes 11, plate-shaped fins 12, first header 15, and second header 16 are manufactured in advance and assembled, and subsequently, are integrally brazed in a furnace. Outdoor heat exchanger 3 manufactured as described above is connected to refrigerant pipes 9 and 10 by, for example, torch brazing.

For the convenience of the description, a portion of outdoor heat exchanger 3 which performs heat exchange between the refrigerant flowing in flat tubes 11 and the outside air flowing between plate-shaped fins 12 is referred to as a heat exchange body 17. Heat exchange body 17 is a portion sandwiched between plate-shaped fin 12 located closest to first header 15 in first direction A and plate-shaped fin 12 located closest to second header 16 in first direction A. In heat exchange body 17, flat tubes 11 and plate-shaped fins 12 are provided in, for example, a certain relationship. Heat exchange body 17 is provided between first header 15 and second header 16 in first direction A.

<Operations of Air Conditioner and Outdoor Heat Exchanger>

The operations of air conditioner 1 and outdoor heat exchanger 3 according to Embodiment 1 will now be described with reference to FIGS. 1 to 3. Air conditioner 1 can perform cooling operation, heating operation, and defrosting operation. Air conditioner 1 is switched among cooling operation, defrosting operation, and heating operation by four-way valve 6 switching the refrigerant circuit. In FIG. 1, the direction in which refrigerant flows during cooling operation and during defrosting operation is indicated by a dashed arrow, and the direction in which refrigerant flows during heating operation is indicated by a solid arrow.

The refrigerant circuit in which compressor 2, outdoor heat exchanger 3, expansion valve 4, and indoor heat exchanger 5 are connected in order is formed during the cooling operation of air conditioner 1. The refrigerant compressed by compressor 2 is sent to outdoor heat exchanger 3. The refrigerant sent to outdoor heat exchanger 3 is subjected to heat exchange between the air sent from outdoor fan 7 and the refrigerant, and is condensed. Outdoor heat exchanger 3 acts as a condenser.

The refrigerant circuit in which compressor 2, indoor heat exchanger 5, expansion valve 4, and outdoor heat exchanger 3 are connected in order is formed during the heating operation of air conditioner 1. The refrigerant compressed by compressor 2 is sent to indoor heat exchanger 5. The refrigerant sent to indoor heat exchanger 5 is subjected to heat exchange between the air sent from indoor fan 8 and the refrigerant, and is condensed. The condensed refrigerant is decompressed by expansion valve 4, and is subsequently sent to outdoor heat exchanger 3. The refrigerant sent to outdoor heat exchanger 3 is subjected to heat exchange between the air sent from outdoor fan 7 and the refrigerant, and is evaporated. Outdoor heat exchanger 3 acts as an evaporator. At this time, the moisture contained in the outside air is condensed by outdoor heat exchanger 3, generating condensed water on the surfaces of flat tubes 11 and plate-shaped fins 12. The condensed water is efficiently drained out of outdoor heat exchanger 3 (which will be described below in detail). A part of the condensed water may turn into water and adhere to outdoor heat exchanger 3.

The frost adhering to outdoor heat exchanger 3 impedes heat exchange between the refrigerant and outside air, leading to a degraded heat efficiency of air conditioner 1. Air conditioner 1 thus performs the defrosting operation for melting the frost adhering to outdoor heat exchanger 3.

During the defrosting operation of air conditioner 1, a refrigerant circuit similar to that during cooling operation is formed. The refrigerant compressed by compressor 2 is sent to outdoor heat exchanger 3 and heats the frost adhering to outdoor heat exchanger 3 to melt it. This allows the frost adhering to outdoor heat exchanger 3 during heating operation to melt through defrosting operation into water. The melted water is efficiently drained out of outdoor heat exchanger 3 (which will be described below in detail). Outdoor fan 7 and indoor fan 8 are, for example, stopped during defrosting operation. Outdoor fan 7 may operate during defrosting operation.

<Function and Effect>

The function and effect of outdoor heat exchanger 3 according to Embodiment 1 will now be described. Outdoor heat exchanger 3 includes flat tubes 11 provided to extend in first direction A and plate-shaped fins 12 having surfaces 12S extending in second direction B different from first direction A. Surfaces 12S of plate-shaped fins 12 are spaced apart from each other in first direction A. Flat tubes 11 penetrate surfaces 12S. Flat tubes 11 include first flat tube 13 located most windward in second direction B and second flat tube 14 spaced apart from first flat tube 13 and disposed most leeward in second direction B. In second direction B, distance u between leeward edge 12B of surface 12S and the center of the flat shape of second flat tube 14 (a line segment 14C extending in the third direction through the center) is at least one-third of width L between windward edge 12A and leeward edge 12B of surface 12S.

A conventional fin-and-tube outdoor heat exchanger has distance u of less than one-third of width L. In the conventional outdoor heat exchanger, accordingly, a partial region of the fin located further leeward of the flat tube located most leeward has an insufficient area serving as a drain path for condensed water or melted water. As such, the conventional outdoor heat exchanger has insufficient drainage efficiency for the condensed water or melted water adhering to the periphery of the flat tube. For example, condensed water easily stays on the flat tube during heating operation, and melted water easily stays on the flat tube at the start of heating operation after defrosting operation. The conventional outdoor heat exchanger thus suffers from an increased ventilation resistance during heating operation, a decreased resistance to frost formation, an impaired comfort associated with an increase in defrosting operation time, or reduced heating ability associated with an increase in the frequency of defrosting operations.

In contrast, since distance u is at least one-third of width L in outdoor heat exchanger 3, a partial region of plate-shaped fin 12 located between fourth end 14B of second flat tube 14 and leeward edge 12B of plate-shaped fin 12 has a sufficient area as a drainage flow path for condensed water or melted water. Outdoor heat exchanger 3 accordingly has high drainage efficiency for the condensed water and melted water adhering to the peripheries of flat tubes 11 compared with the conventional outdoor heat exchanger. Consequently, outdoor heat exchanger 3 has an increased ventilation resistance during heating operation, a decreased resistance to frost formation, an impaired comfort associated with an increase in defrosting operation time, and reduced heating ability associated with an increase in the frequency of defrosting operations, all of which are better than those of the conventional outdoor heat exchanger.

<Modifications>

Modifications of outdoor heat exchanger 3 according to Embodiment 1 will now be described with reference to FIGS. 4 to 6. Although outdoor heat exchanger 3 shown FIG. 3 is disposed such that the long axes of the flat shapes of flat tubes 11 thereof are each disposed to extend in second direction B, the present invention is not limited thereto.

Figure 4:
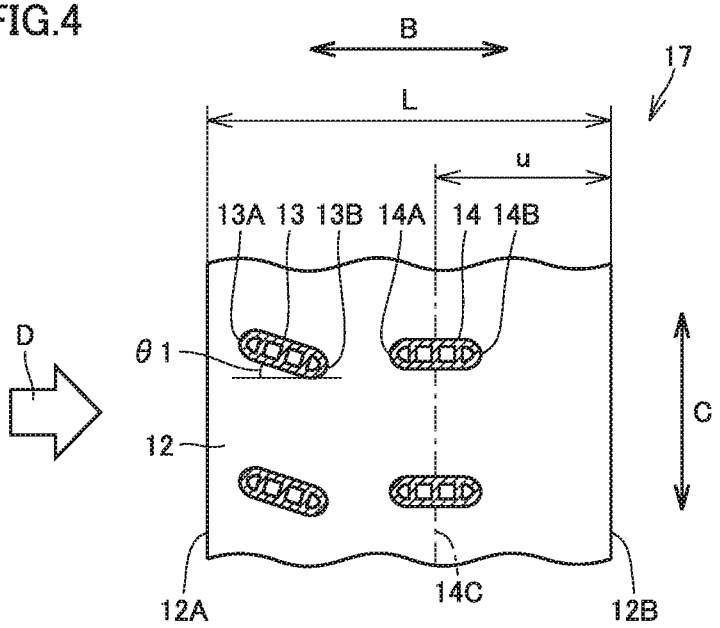
FIG. 4 is a sectional view showing, on an enlarged scale, a major portion of a modification of the heat exchanger according to Embodiment 1.

As shown in FIG. 4, the long axis of the flat shape of first flat tube 13 may be inclined to second direction B. In other words, first end 13A of first flat tube 13 may be disposed above second end 13B. A first angle θ1 formed between the long axis of first flat tube 13 and second direction B is, for example, 5° or more and 25° or less. The long axis of the flat shape of second flat tube 14 may extend in the second direction at this time.

Figure 5:
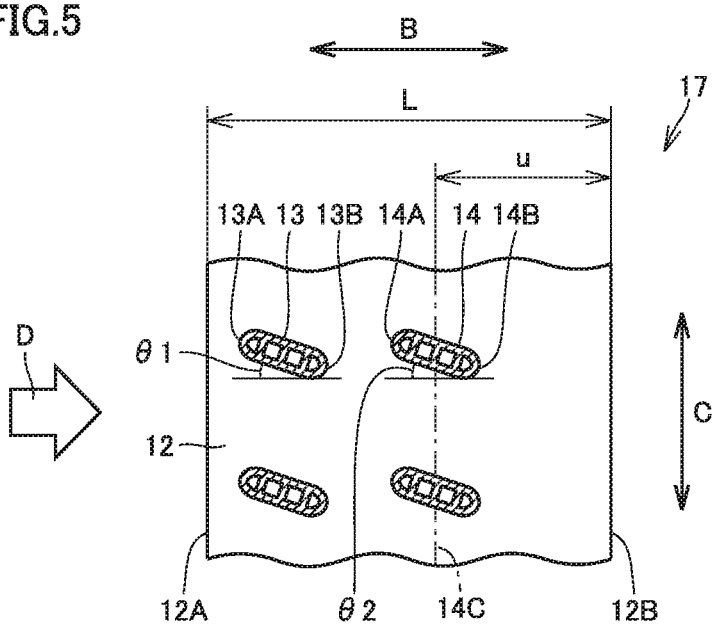
FIG. 5 is a sectional view showing, on an enlarged scale, a major portion of another modification of the heat exchanger according to Embodiment 1.

As shown in FIG. 5, the long axis of the flat shape of second flat tube 14 may be inclined to the second direction, in addition to first flat tube 13. In other words, third end 14A of second flat tube 14 may be disposed above fourth end 14B of second flat tube 14. A second angle θ2 formed between the long axis of second flat tube 14 and second direction B is, for example, 5° or more and 25° or less. First angle θ1 and second angle θ2 may be, for example, equal to each other. First angle θ1 is preferably greater than second angle θ2.

Figure 6:
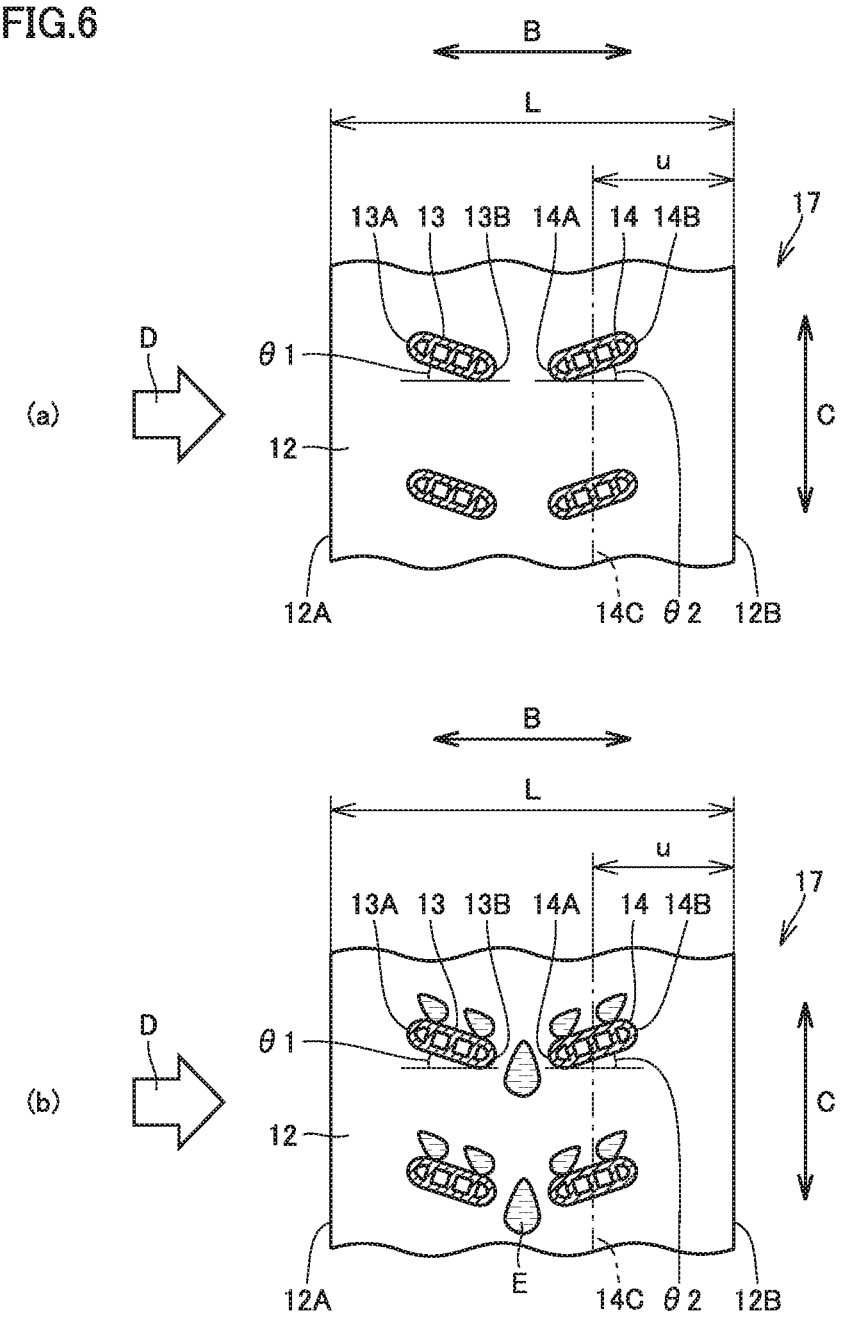
FIG. 6 is a sectional view showing, on an enlarged scale, a major portion of still another modification of the heat exchanger according to Embodiment 1.

As shown in FIGS. 6(*a*) and (*b*), first end 13A of first flat tube 13 may be disposed above second end 13B of first flat tube 13, and also, third end 14A of second flat tube 14 may be disposed below fourth end 14B of second flat tube 14. In other words, first flat tube 13 and second flat tube 14 may be provided such that the longitudinal direction of the flat shape of first flat tube 13 and the longitudinal direction of the flat shape of second flat tube 14 cross each other between first flat tube 13 and second flat tube 14 when outdoor heat exchanger 3 is seen in first direction A.

Figure 3:
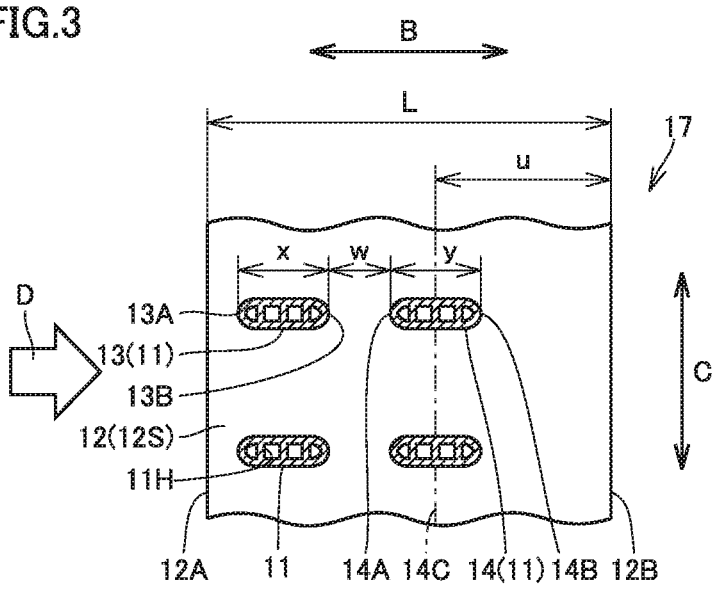
FIG. 3 is a sectional view showing, on an enlarged scale, a major portion of the arrangement of flat tubes in the heat exchanger according to Embodiment 1.

In outdoor heat exchangers 3 having the configurations shown in FIGS. 4 to 6, since the long axis of the flat shape of first flat tube 13 is inclined to second direction B, the condensed water or melted water adhering to the periphery of first flat tube 13 can be drained smoothly under the gravity compared with outdoor heat exchanger 3 having the configuration shown in FIG. 3. Specifically, with reference to FIG. 6(*b*), water E (condensed water or melted water) adhering to the periphery of first flat tube 13 can pass through on the outer surface of first flat tube 13 and guided between first flat tube 13 and second flat tube 14 thanks to the wind force acting from windward to leeward in second direction B produced by gas D blown from outdoor fan 7 and thanks to the gravity acting from above to below in third direction C, thereby being drained smoothly. Consequently, outdoor heat exchangers 3 having the configurations shown in FIGS. 4 to 6 have a drainage efficiency higher than that of outdoor heat exchanger 3 shown in FIG. 3.

In particular, outdoor heat exchanger 3 shown in FIG. 5, in which third end 14A of second flat tube 14 is disposed above fourth end 14B of second flat tube 14, can more smoothly drain the condensed water or melted water adhering to the periphery of second flat tube 14 located at the leeward side at which a sufficient volume of wind force produced by gas D blown from outdoor fan 7 arrives less easily.

Embodiment 2

An outdoor heat exchanger according to Embodiment 2 will now be described with reference to FIG. 7. The outdoor heat exchanger according to Embodiment 2 basically has a configuration similar to that of the outdoor heat exchanger according to Embodiment 1 but differs therefrom in that in second direction B, distance s between the center of the flat shape of first flat tube 13 (a line segment 13C extending in the third direction through the center) and windward edge 12A of plate-shaped fin 12 is at least one-third of width L of plate-shaped fin 12.

In the outdoor heat exchanger according to Embodiment 2, distance u and distance s are each at least one-third of width L.

In a conventional fin-and-tube outdoor heat exchanger, distance s is less than one-third of width L. In the conventional outdoor heat exchanger, accordingly, the windward edge of the fin is cooled to an extent similar to that of the refrigerant flowing through the flat tube located windward during heating operation, resulting in an approximately uniform surface temperature of the fin from the windward edge to the leeward edge. In contrast, the temperature of a gas flowing on the surface of the fin gradually decreases from the windward edge of the fin to the leeward edge of the fin during heating operation. The conventional outdoor heat exchanger exhibits a distribution of a heat exchange amount between refrigerant and outside air via a fin, in which the heat exchange amount is greatest at the windward edge of the fin and gradually decreases toward the leeward edge. The frost formation amount on the fin surface also exhibits a distribution in which the frost formation amount is greatest windward and gradually decreases toward the leeward edge. In the conventional outdoor heat exchanger, particularly on the windward side thereof, accordingly, between adjacent fins is easily blocked by frost, and drainage water that has passed through on the fin surface is blocked, allowing condensed water or melted water to easily stay on the fin surface.

In contrast, the outdoor heat exchanger according to Embodiment 2 has distance s that is at least one-third of width L. Windward edge 12A of plate-shaped fin 12 is accordingly not cooled to an extent similar to that of the refrigerant flowing through first flat tube 13 located windward during heating operation, and the surface temperature of plate-shaped fin 12 exhibits a temperature distribution in which the surface temperature gradually decreases from windward edge 12A to leeward edge 12B. In the outdoor heat exchanger according to Embodiment 2, thus, the heat exchange amount between refrigerant and outside air via plate-shaped fin 12 exhibits an approximately uniform distribution from windward edge 12A of plate-shaped fin 12 to leeward edge 12B of plate-shaped fin 12. The frost formation amount on the surface of plate-shaped fin 12 also exhibits an approximately uniform distribution from the windward edge to the leeward edge. In the outdoor heat exchanger according to Embodiment 2, thus, the blockage between adjacent fins is prevented or reduced also on the windward side, leading to high drainage efficiency.

Since the outdoor heat exchanger according to Embodiment 2 has a configuration similar to that of outdoor heat exchanger 3 according to Embodiment 1, it can achieve effects similar to those of outdoor heat exchanger 3. In the outdoor heat exchanger according to Embodiment 2, the long axis of the flat shape of at least one of flat tubes 11 may be inclined to second direction B as in the modifications of outdoor heat exchanger 3 described above.

Embodiment 3

An outdoor heat exchanger according to Embodiment 3 will now be described with reference to FIG. 8. The outdoor heat exchanger according to Embodiment 3 basically has a configuration similar to that of the outdoor heat exchanger according to Embodiment 1 but differs therefrom in that distance u is less than one-third of width L in second direction B and that distance s is at least one-third of width L. In other words, the outdoor heat exchanger according to Embodiment 3 basically has a configuration similar to that of the outdoor heat exchanger according to Embodiment 2 but differs therefrom in that distance u is less than one-third of width L in second direction B.

In the outdoor heat exchanger according to Embodiment 3, distance s is at least one-third of width L, and accordingly, blockage between adjacent fins by frost is prevented or reduced also on the windward side as in the outdoor heat exchanger according to Embodiment 2, leading to high drainage efficiency.

<Modifications>

Modifications of the outdoor heat exchanger according to Embodiment 3 will now be described with reference to FIGS. 9 to 11.

Figure 9:
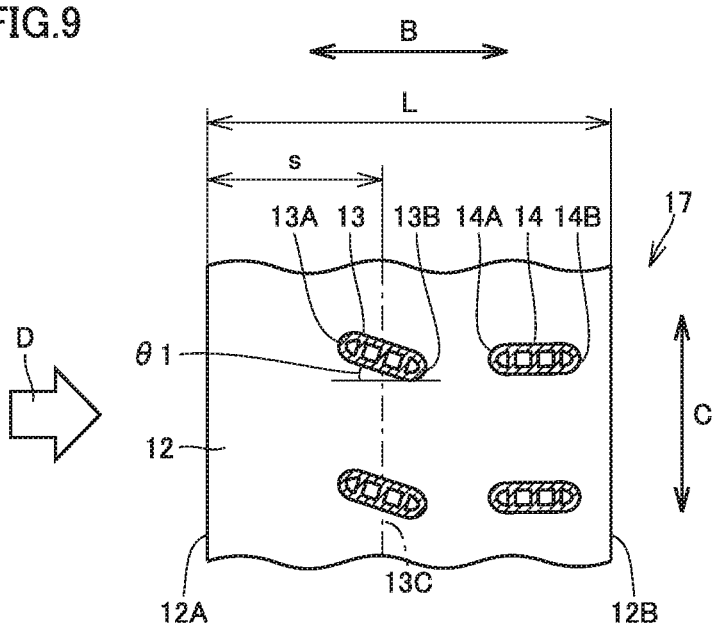
FIG. 9 is a sectional view showing, on an enlarged scale, a major portion of a modification of the heat exchanger according to Embodiment 3.

As shown in FIG. 9, the long axis of the flat shape of first flat tube 13 may be inclined to second direction B. In other words, first end 13A of first flat tube 13 may be disposed above second end 13B. First angle θ1 formed between the long axis of first flat tube 13 and second direction B is, for example, 5° or more and 25° or less. The long axis of the flat shape of second flat tube 14 may extend in the second direction at this time.

Figure 10:
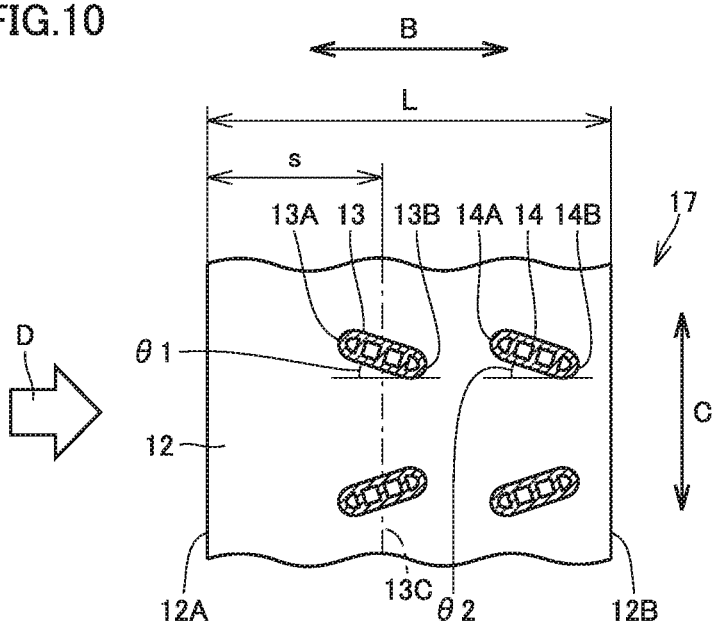
FIG. 10 is a sectional view showing, on an enlarged scale, a major portion of another modification of the heat exchanger according to Embodiment 3.

As shown in FIG. 10, the long axis of the flat shape of second flat tube 14 may be inclined to the second direction, in addition to first flat tube 13. In other words, third end 14A of second flat tube 14 may be disposed above fourth end 14B. Second angle θ2 formed between the long axis of second flat tube 14 and second direction B is, for example, 5° or more and 25° or less. First angle θ1 and second angle θ2 may be, for example, equal to each other. First angle θ1 is preferably greater than second angle θ2.

Figure 11:
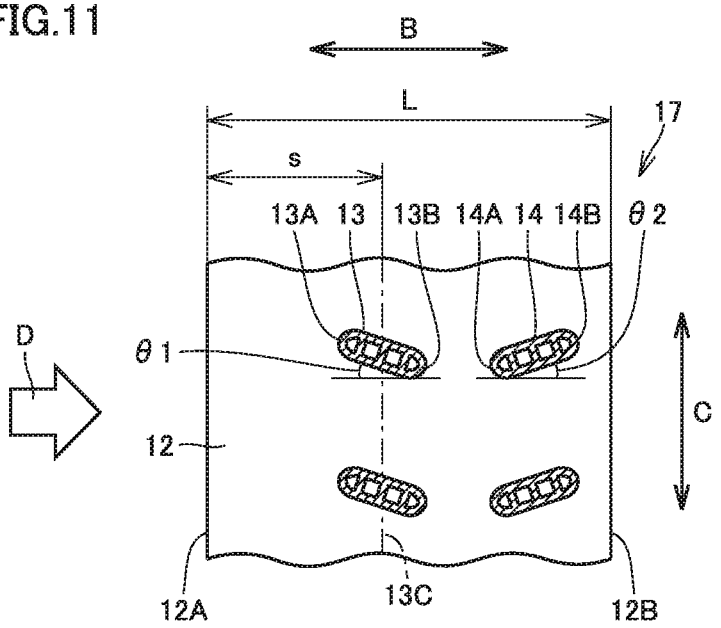
FIG. 11 is a sectional view showing, on an enlarged scale, a major portion of still another modification of the heat exchanger according to Embodiment 3.

As shown in FIG. 11, first end 13A of first flat tube 13 may be disposed above second end 13B, and third end 14A of second flat tube 14 may be disposed below fourth end 14B. In other words, first flat tube 13 and second flat tube 14 may be provided such that the longitudinal direction of the flat shape of first flat tube 13 and the longitudinal direction of the flat shape of second flat tube 14 cross each other between first flat tube 13 and second flat tube 14 when outdoor heat exchanger 3 is seen in first direction A.

Figure 8:
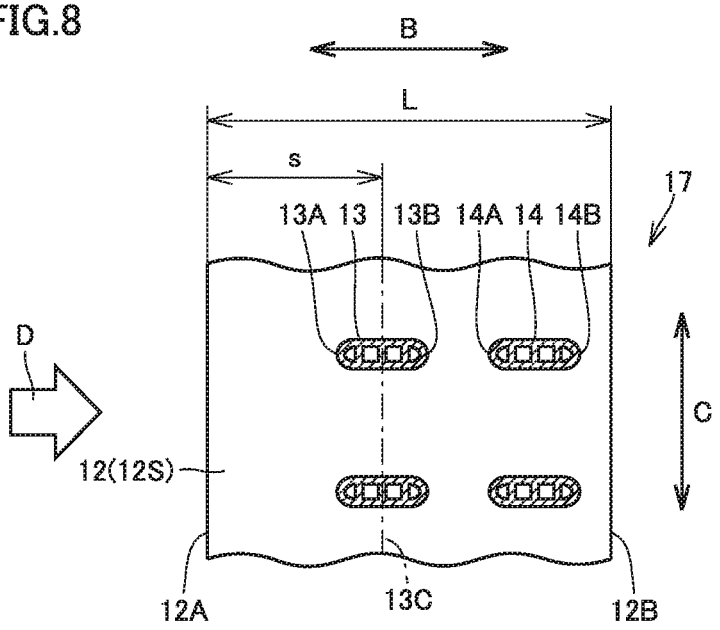
FIG. 8 is a sectional view showing, on an enlarged scale, a major portion of the arrangement of flat tubes in a heat exchanger according to Embodiment 3.

In the outdoor heat exchangers having the configurations shown in FIGS. 9 to 11, since the long axis of the flat shape of first flat tube 13 is inclined to second direction B, condensed water or melted water adhering to the periphery of first flat tube 13 can be smoothly drained under the gravity compared with outdoor heat exchanger 3 having the configuration shown in FIG. 8. Specifically, the condensed water or melted water adhering to the periphery of first flat tube 13 can pass through on the outer surface of first flat tube 13 to be guided to between first flat tube 13 and second flat tube 14 thanks to the wind force acting from windward to leeward in second direction B produced by gas D blown from outdoor fan 7 and thanks to the gravity acting from above to below in third direction C, thereby being drained smoothly. Consequently, the outdoor heat exchangers having the configurations shown in FIGS. 9 to 11 have a drainage efficiency higher than that of outdoor heat exchanger 3 shown in FIG. 8.

In particular, outdoor heat exchanger 3 shown in FIG. 10, in which third end 14A of second flat tube 14 is disposed above fourth end 14B of second flat tube 14, can more smoothly drain the condensed water or melted water adhering to the periphery of second flat tube 14 located at the leeward side at which a sufficient amount of the wind force produced by gas D blown from outdoor fan 7 arrives less easily.

Embodiment 4

Figure 12:
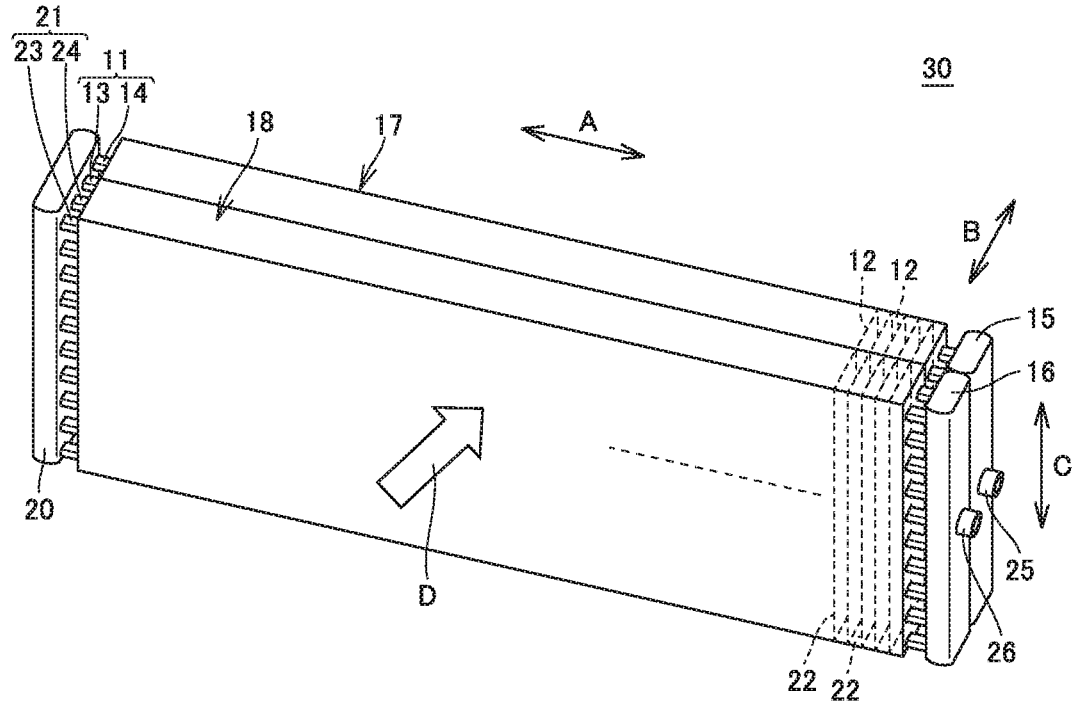
FIG. 12 is a perspective view of a heat exchanger according to Embodiment 4.

An outdoor heat exchanger 30 according to Embodiment 4 will now be described with reference to FIG. 12. Outdoor heat exchanger 30 according to Embodiment 4 basically has a configuration similar to that of outdoor heat exchanger 3 according to Embodiment 1 but differs therefrom in that it includes heat exchange body 17 according to Embodiment 1 shown in FIG. 3 and another heat exchange body 18 disposed windward of heat exchange body 17 in second direction B and connected in series with heat exchange body 17 in the refrigerant circuit.

Heat exchange body 18 is configured as, for example, a portion that performs heat exchange between the refrigerant flowing in flat tubes 21 and outside air flowing between fins 22. That is to say, outdoor heat exchanger 30 further includes a plurality of flat tubes 21 and a plurality of plate-shaped fins 22, in addition to flat tubes 11 and plate-shaped fins 12. It suffices that heat exchange body 18 has any appropriate configuration.

Flat tubes 21 are provided windward of flat tubes 11 in second direction B. Flat tubes 21 basically have a configuration similar to that of, for example, flat tubes 11. Flat tubes 21 have a flat shape in which a sectional shape perpendicular to first direction A has a long axis and a short axis. The refrigerant flow paths formed in flat tubes 21 are connected in series with the refrigerant flow paths formed in flat tubes 11 via a folded header 20.

Plate-shaped fins 22 are provided windward of plate-shaped fins 12 in second direction B. Plate-shaped fins 22 basically have a configuration similar to that of plate-shaped fins 12.

In outdoor heat exchanger 30 described above, of heat exchange body 17 and heat exchange body 18, heat exchange body 17 is disposed most leeward, and distance u is at least one-third of width L in heat exchange body 17. Outdoor heat exchanger 30 can thus achieve effects similar to those of outdoor heat exchanger 3 according to Embodiment 1.

<Modifications>

Modifications of outdoor heat exchanger 30 according to Embodiment 4 will now be described.

Outdoor heat exchanger 30 may include heat exchange body 17 shown in any of FIGS. 3 to 6 and another heat exchange body 18 disposed windward of heat exchange body 17 in second direction B and connected in series with heat exchange body 17 in the refrigerant circuit.

Figure 7:
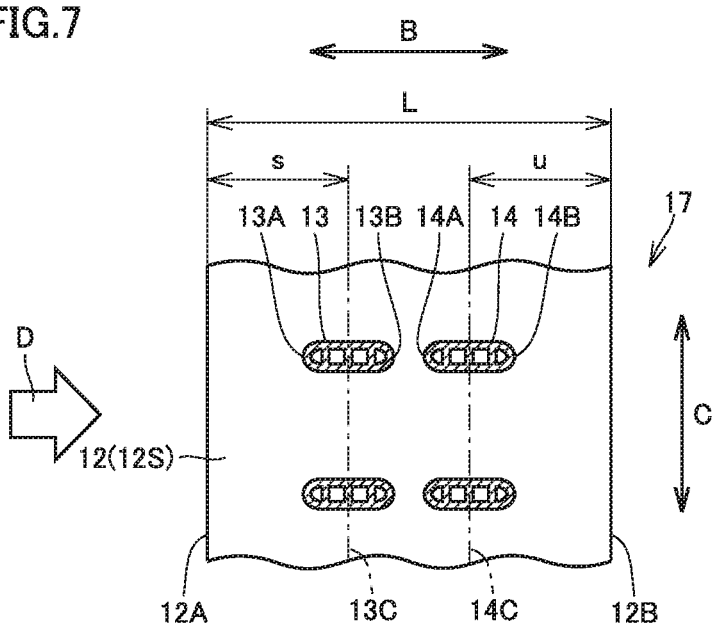
FIG. 7 is a sectional view showing, on an enlarged scale, a major portion of still another modification of a heat exchanger according to Embodiment 2.

Outdoor heat exchanger 30 may include heat exchange body 17 shown in FIG. 7 and another heat exchange body 18 disposed windward or leeward of heat exchange body 17 in second direction B and connected in series with heat exchange body 17 in the refrigerant circuit. When heat exchange body 17 of heat exchange body 17 and heat exchange body 18 a is disposed most leeward, distance u is at least one-third of width L in heat exchange body 17. Outdoor heat exchanger 30 can thus achieve effects similar to those of outdoor heat exchanger 3 according to Embodiment 1. Contrastingly, when heat exchange body 17 of heat exchange body 17 and heat exchange body 18 is disposed most windward, distance s is at least one-third of width L in heat exchange body 17. Outdoor heat exchanger 30 can thus achieve effects similar to those of outdoor heat exchanger 3 according to Embodiment 3.

Outdoor heat exchanger 30 may include heat exchange body 17 shown in any of FIGS. 8 to 11 and another heat exchange body 18 disposed leeward of heat exchange body 17 in second direction B and connected in series with heat exchange body 17 in the refrigerant circuit. In outdoor heat exchanger 30 as described above, heat exchange body 17 of heat exchange body 17 and heat exchange body 18 is disposed most windward, and distance s is at least one-third of width L in heat exchange body 17. Outdoor heat exchanger 30 can thus achieve effects similar to those of outdoor heat exchanger 3 according to Embodiment 3.

Outdoor heat exchanger 30 may include two or more heat exchange bodies 17 selected from heat exchange bodies 17 shown in FIGS. 3 to 11. For example, outdoor heat exchanger 30 may include a heat exchange body 17 according to Embodiment 2 of 3 shown in any of FIGS. 7 to 11 and another heat exchange body 17 according to Embodiment 1 or 2 shown in any of FIGS. 3 to 7. In this case, heat exchange body 17 according to Embodiment 1 or 2 shown in any of FIGS. 3 to 7 is preferably disposed leeward of the other heat exchange body 17 according to Embodiment 2 or 3 shown any of in FIGS. 7 to 11 and connected in series with the other heat exchange body 17 in the refrigerant circuit.

Figure 13:
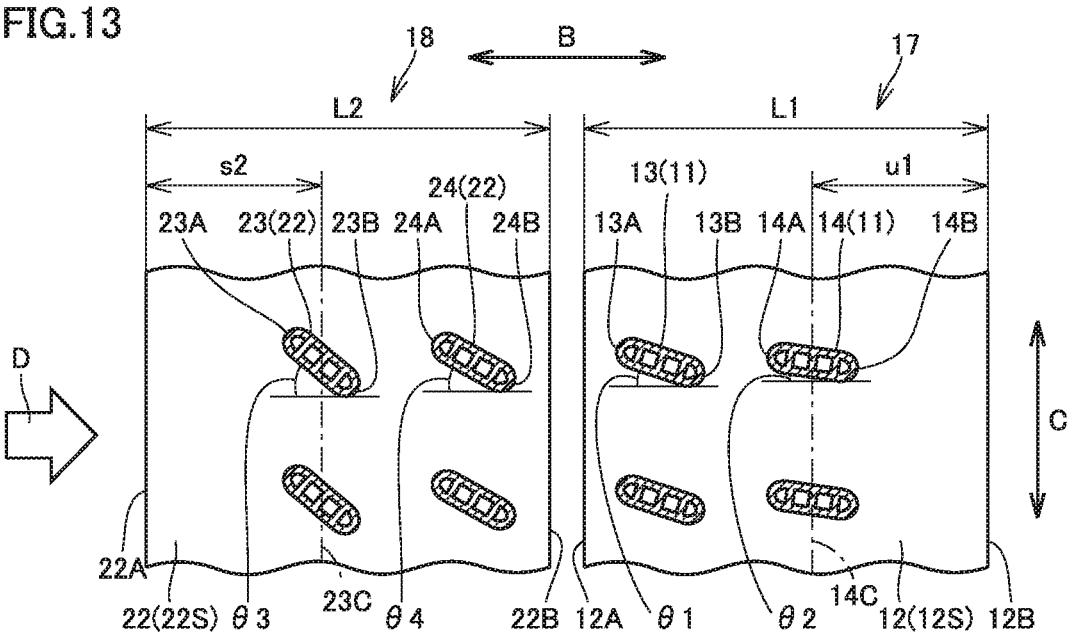
FIG. 13 is a sectional view showing, on an enlarged scale, a major portion of the arrangement of flat tubes in the heat exchanger according to Embodiment 4.

With reference to FIG. 13, an angle formed by the long axis of the flat shape of each of flat tubes disposed side by side in second direction B among flat tubes 11 and flat tubes 21 of outdoor heat exchanger 30 with respect to second direction B is preferably provided to be gradually smaller from windward to leeward.

In this case, heat exchange body 18 located windward has a configuration similar to that of, for example, heat exchange body 17 shown in FIG. 10. Heat exchange body 17 located leeward has a configuration similar to that of, for example, heat exchange body 17 shown in FIG. 4 or 5.

Flat tubes 21 include a third flat tube 23 and a fourth flat tube 24. Third flat tube 23 is disposed most windward among flat tubes 21. Fourth flat tube 24 is disposed most leeward among flat tubes 21. Third flat tube 23 and fourth flat tube 24 are disposed, for example, at an interval W2 in second direction B. Third flat tube 23 and fourth flat tube 24 have, for example, configurations similar to those of first flat tube 13 and second flat tube 14 of heat exchange body 17. Third flat tube 23 and fourth flat tube 24 constitute a flat tube group. Flat tubes 21 include a plurality of such flat tube groups.

In second direction B, a distance s2 between the center of the flat shape of third flat tube 23 (a line segment 23C extending in the third direction through the center) and windward edge 22A of plate-shaped fin 22 is at least one-third of width L2 of plate-shaped fin 22.

The long axis of the flat shape of third flat tube 23 is inclined to second direction B at a third angle θ3. The long axis of the flat shape of fourth flat tube 24 is inclined to second direction B at a fourth angle θ4. First angle θ1, second angle θ2, third angle θ3, and fourth angle θ4 are provided such that third angle θ3>fourth angle θ4>first angle θ1>second angle θ2. Second angle θ2 is 0° or more.

Since outdoor heat exchanger 30 as described above has great inclination angles of third flat tube 23 and fourth flat tube 24 that are located windward where a frost formation amount is great, it has high drainage efficiency at the windward side.

Although two flat tubes (first flat tube 13 and second flat tube 14, or third flat tube 23 and fourth flat tube 24)

separated apart from each other in second direction B are provided to penetrate plate-shaped fins 12 and 22 in Embodiments 1 to 4, the present invention is not limited thereto. One or more flat tubes may be provided in a region located leeward of first flat tube 13 and windward of second flat tube 14 in second direction B. In other words, the flat tubes may include a plurality of flat tube groups each formed of three or more flat tubes spaced apart from each other in second direction B.

It should be understood that the embodiments disclosed herein are illustrative and non-restrictive in every respect. It is therefore intended that the scope of the present invention is defined by claims, not only by the embodiments described above, and encompasses all modifications and variations equivalent in meaning and scope to the claims.

INDUSTRIAL APPLICABILITY

The present invention is particularly advantageously applied to a heat exchanger used as an evaporator in, for example, an air conditioner or a refrigerator.

REFERENCE SIGNS LIST

1 air conditioner, 2 compressor, 3, 30 outdoor heat exchanger, 4 expansion valve, 5 indoor heat exchanger, 6 four-way valve, 7 outdoor fan, 8 indoor fan, 9, 10 refrigerant pipe, 11, 21 flat tube, 12, 22 plate-shaped fin, 13 first flat tube, 14 second flat tube, 15 first header, 16 second header, 17, 18 heat exchange body, 20 folded header, 23 third flat tube, 24 fourth flat tube, 25, 26 refrigerant port.

The invention claimed is:

1. A heat exchanger comprising:

a plurality of flat tubes provided to extend in a first direction; and a plurality of plate-shaped fins having respective surfaces extending in a second direction different from the first direction, the surfaces of the plurality of plate-shaped fins being spaced apart from each other in the first direction, each of the surfaces having a windward edge located windward in the second direction and a leeward edge located leeward in the second direction, the plurality of flat tubes penetrating the surfaces, the plurality of flat tubes comprising a first flat tube disposed most windward in the second direction, and a second flat tube spaced apart from the first flat tube and disposed most leeward in the second direction, the first flat tube having a first end located windward in the second direction and a second end located leeward in the second direction, the second flat tube having a third end located windward in the second direction and fourth end located leeward in the second direction, the second flat tube being disposed leeward of the second end of the first flat tube, the third end of the second flat tube being disposed leeward of the second end of the first flat tube, in the second direction, a distance between the leeward edge of each of the surfaces and a center of a flat shape of the second flat tube being at least one-third of a width between the windward edge and the leeward edge of each of the surfaces.

2. The heat exchanger according to claim 1, wherein a distance in the second direction between the windward edge of each of the surfaces and a center of a flat shape of the first flat tube is at least one-third of the width of each of the surfaces.

3. A heat exchanger comprising:

a plurality of flat tubes provided to extend in a first direction; and a plurality of plate-shaped fins having respective surface extending in a second direction different from the first direction, the surfaces of the plurality of plate-shaped fins being spaced apart from each other in the first direction, each of the surfaces having a windward edge located windward in the second direction and a leeward edge located leeward in the second direction, the plurality of flat tubes penetrating the surfaces, the plurality of flat tubes comprising a first flat tube disposed most windward in the second direction, and a second flat tube spaced apart from the first flat tube and disposed most leeward in the second direction, the first flat tube having a first end located windward in the second direction and a second end located leeward in the second direction, the second flat tube having a third end located windward in the second direction and fourth end located leeward in the second direction, the second flat tube being disposed leeward of the second end of the first flat tube, the third end of the second flat tube being disposed leeward of the second end of the first flat tube, in the second direction, a distance between the windward edge of each of the surfaces and a center of a flat shape of the first flat tube being at least one-third of a width between the windward edge and the leeward edge of each of the surfaces.

4. The heat exchanger according to claim 1, wherein a ratio of a sum of a first length of a long axis of the flat shape of the first flat tube and a second length of a long axis of the flat shape of the second flat tube to the width of each of the surfaces is 0.27 or more and 0.9 or less.

5. The heat exchanger according to claim 4, wherein the first direction and the second direction extend horizontally, and the long axis of the flat shape of at least one of the first flat tube and the second flat tube is inclined to the second direction.

6. The heat exchanger according to claim 5, wherein the second end is located below the first end in a direction of gravity.

7. The heat exchanger according to claim 6, wherein the fourth end is disposed below the third end in the direction of gravity, and a first angle formed by the long axis of the first flat tube with respect to the second direction is greater than a second angle formed by the long axis of the second flat tube with respect to the second direction.

8. The heat exchanger according to claim 6, wherein the fourth end is disposed above the third end in the direction of gravity.

9. The heat exchanger according to claim 7, wherein a distance between the second end of the first flat tube and the third end of the second flat tube is at least 2 mm in the second direction.

10. The heat exchanger according to claim 8, wherein a distance between the second end of the first flat tube and the third end of the second flat tube is at least 2 mm in the second direction.

11. The heat exchanger according to claim 3, wherein a ratio of a sum of a first length of a long axis of the flat shape of the first flat tube and a second length of a long axis of the flat shape of the second flat tube to the width of each of the surfaces is 0.27 or more and 0.9 or less.

12. The heat exchanger according to claim 11, wherein the first direction and the second direction extend horizontally, and the long axis of the flat shape of at least one of the first flat tube and the second flat tube is inclined to the second direction.

13. The heat exchanger according to claim 12, wherein the second end is located below the first end in a direction of gravity.

14. The heat exchanger according to claim 13, wherein the fourth end is disposed below the third end in the direction of gravity, and a first angle formed by the long axis of the first flat tube with respect to the second direction is greater than a second angle formed by the long axis of the second flat tube with respect to the second direction.

15. The heat exchanger according to claim 13, wherein the fourth end is disposed above the third end in the direction of gravity.

16. The heat exchanger according to claim 14, wherein a distance between the second end of the first flat tube and the third end of the second flat tube is at least 2 mm in the second direction.

17. The heat exchanger according to claim 15, wherein a distance between the second end of the first flat tube and the third end of the second flat tube is at least 2 mm in the second direction.

* * * * *